US006733632B2

(12) United States Patent
Winheim et al.

(10) Patent No.: US 6,733,632 B2
(45) Date of Patent: May 11, 2004

(54) PROCESS AND APPARATUS FOR THE ON-LINE CALENDERING OF SC-A PAPER

(75) Inventors: Stefan Winheim, Frankfurt am Main (DE); Rudolf Mann, Frankfurt am Main (DE); Manfred Diebel, Limeshain (DE)

(73) Assignee: V. I. B. Systems GmbH, Maintal (DE)

( * ) Notice: Subject to any disclaimer, the term of this patent is extended or adjusted under 35 U.S.C. 154(b) by 0 days.

(21) Appl. No.: 10/285,735

(22) Filed: Nov. 1, 2002

(65) Prior Publication Data

US 2003/0056920 A1 Mar. 27, 2003

Related U.S. Application Data

(60) Division of application No. 09/711,580, filed on Nov. 13, 2000, now Pat. No. 6,500,305, which is a continuation-in-part of application No. 09/186,401, filed on Nov. 4, 1998, now abandoned.

(30) Foreign Application Priority Data

Aug. 18, 1998 (DE) ..... 198 35 989

(51) Int. Cl.[7] ..... D21H 11/00; B02C 11/08

(52) U.S. Cl. ..... 162/266; 162/265; 162/361; 100/333; 100/331; 100/161

(58) Field of Search ..... 131/365, 349, 131/73; 162/181.4, 139

(56) References Cited

U.S. PATENT DOCUMENTS 5,378,497 A * 1/1995 Johnson et al. ..... 427/211

* cited by examiner

*Primary Examiner*—Dionne A. Walls
(74) *Attorney, Agent, or Firm*—Friedrich Kueffner

(57) ABSTRACT

A process and an apparatus for the manufacture of SC-A paper having a high gloss and high smoothness, wherein the paper arriving from the paper machine is supplied on-line to a supercalender (multinip soft calendar), and wherein the paper travels through a plurality of nips for achieving the desired gloss and smoothness properties. The paper web arriving from the paper machine and supplied on-line to a supercalender (multinip soft calendar) is moistened with steam immediately prior to the first nip of the supercalender and is guided through the first nip before the increased moisture of the surface resulting from the application of steam has dropped below a predetermined value in the range of 12% to 25%.

10 Claims, 2 Drawing Sheets

PROCESS AND APPARATUS FOR THE ON-LINE CALENDERING OF SC-A PAPER

This Application is a Divisional of Ser. No. 09/711,580 filed on Nov. 13, 2000, now U.S. Pat. No. 6,500,305, and is a Continuation in Part of Ser. No. 09/186,401 filed on Nov. 4, 1998, now Abandoned.

BACKGROUND OF THE INVENTION

1. Field of the Invention

The present invention relates to a process for the manufacture of paper having a high smoothness, wherein the paper arriving from the paper machine is supplied on-line to a supercalender (multinip soft calendar), wherein the paper travels through a plurality of nips for achieving the desired and smoothness properties.

The present invention also relates to an apparatus for carrying out the process.

2. Description of the Related Art

Gloss and smoothness are characteristics of a paper web which not only influence the appearance of the paper web but also the possibilities of further processing of the paper web. In certain types of applications, gloss and/or smoothness values are desired which are to be reproducible as uniformly as possible.

Gloss and smoothness of the paper web are usually increased by conducting the paper web following the dry end of the paper machine into a smoothing unit which is composed of one or more nips, wherein the gloss and/or the smoothness of the paper web is increased by the pressure in the nip and the temperature of the rolls forming the nip. However, this makes it only possible to influence the gloss and smoothness of the paper web to a limited extent because, when the pressure in the nip is increased too much, the paper web is compressed too much and a volume loss of the paper web occurs. In this connection, there is the additional danger that the paper web loses stiffness. There are also limits with respect to the increase of the roll temperature because this increase requires a large amount of energy. For example, for achieving roll temperatures of 200° C., significant quantities of energy must be supplied because the rolls are continuously cooled by the paper web travelling past the rolls.

Therefore, it has already been attempted, for example, in silicon papers, to influence the gloss and smoothness of the paper web by the moisture of the paper web. However, this has the disadvantage that after the treatment the supplied moisture has to be removed at least partially which requires additional process steps which, in turn, increase the time required for the treatment of the paper web and the apparatus is more complicated.

Basically, there are essentially two types of smoothing units. So-called supercalenders have a plurality of rolls arranged one above the other and nips provided between the rolls through which the paper web travels. The large number of nips produces a high degree of overlap or contact and a good distribution of the glazing work between pressure and temperature. Supercalenders are usually provided off-line, i.e., the paper web arriving from the paper machine is initially wound onto a reel-spool and is transferred together with the reel-spool to the supercalender, wherein the paper web travels through the supercalender at a significantly lower speed than the paper machine speed. The off-line installation has the advantage that the paper web can level out or equalize prior to entering the supercalender, so that the operation in the supercalender does not have to be carried out under the requirements of the paper machine which is influenced by many factors. However, the installation requirements are significantly higher. A supercalender classically has heated steel rolls, on the one hand, and paper rolls or rolls covered with cotton, on the other hand. More recently, also so-called multinip soft calendars are used in which the paper rolls are replaced by rolls having polymer covers. These rolls have a different elastic behavior than the paper rolls, so that it is possible to operate with a lower nip pressure.

Secondly, there are so-called machine calendars or soft calendars which can be connected on-line to a paper machine and through which, consequently, the paper web travels with the paper machine speed. However, machine calendars only have a small number of nips, so that the operation is carried out with higher pressure and temperature and, thus, the paper web is stressed to a greater extent. A significant disadvantage of the soft calendars is that not all types of paper can be upgraded to high qualities. In particular, it is not possible to manufacture highly compacted SC-A paper on-line in a soft calendar. It was possible recently to achieve the printing properties of a natural gravure paper supercalendared in 11 nips in a soft calendar with only four nips; however, this requires relatively high roll temperatures and compressive stresses in the nips. Also, these qualities can only be achieved in a range of speeds which corresponds to the glazing speed in the supercalender which is usual for this paper (see: Rothfuss, Ulrich: Inline- und Offline-Satinage von holzhaltigen, tiefdruckfähigen Naturdruckpapieren in: Wochenblatt für Paperfabrikation 1993, No. 11/12, pages 457–466). Consequently, such qualities can only be achieved with the off-line installation of the soft calendar.

DE 43 01 023 C2 discloses in connection with machine calendars a process which provides to apply steam to the paper web immediately prior to the nip and to conduct the paper web through the nip before the temperature and moisture have equalized in the paper web. This not only results in moistening of the paper web, but a temperature increase is achieved simultaneously. The heat contained in the steam is transferred during the condensation onto the paper web, so that this measure produces a paper web which has at the surface thereof the necessary temperature and the necessary moisture. When this paper web is guided through the nip, the nip primarily influences the surface portion of the paper web, while the middle and bottom portions are influenced significantly less. Consequently, no changes worth mentioning occur in the thickness direction in the middle (and bottom) portions. The volume of the paper web is maintained to a greater extent, although the surface quality is significantly improved. However, the on-line manufacture of SC-A papers is not possible with machine calendars of this type.

SUMMARY OF THE INVENTION

Therefore, it is the primary object of the present invention to manufacture paper having a high smoothness on-line.

In accordance with the present invention, the paper web arriving from the paper machine and supplied on-line to a supercalender (multinip soft calendar) is moistened with spray mist and the spray mist is applied onto the paper web about 0.6 to 1.2 s, preferably 0.8 to 1 s, before the paper web travels through the first nip.

The moistening of paper webs by means of nozzle-type moistening units is basically known in the art. A spray head suitable for this purpose is known, for example, from DE 38

19 762 C2. However, since during spraying individual droplets are applied onto the paper web, the paper web is inevitably moistened unevenly. Therefore, this type of moistening has in the past only been used in the off-line treatment of paper webs, so that the moisture has sufficient time to distribute uniformly over the paper web. The on-line moistening has in the past been carried out by means of steam blow boxes, wherein by definition the formation of droplets in the spray mist is to be prevented. However, we have recognized that the selection of an appropriate distance between the spray mist moistening and the first nip of the supercalender makes possible a uniformly moistened paper web even during the on-line installation and on a paper web conveyed with the paper machine speed. It was found that a duration of 0.6 to 1.2 s, preferably 0.8 to 1 s, is sufficient for obtaining, in addition to a uniform moistening across its surface, a paper web that is uniformly moistened in the Z-direction, i.e., across its cross-section or thickness. Accordingly, the selection of the precise position of the moistening device depends significantly on the paper machine speed. At a usual paper machine speed of up to 1,400 m/min and a desired time of application of 0.7 s, the spatial distance of the moistening unit from the first nip is about 16 m. In paper machines with appropriate deflections of the paper web, this can be realized without problems.

In order to ensure that the moisture applied in the form of droplets onto the paper web is distributed evenly sufficiently quickly, a preferred embodiment of the present invention provides that the spray mist is applied in the form of a fine uniform mist with an average droplet size <50 $\mu$m, preferably $\leqq$20 $\mu$m. The formation of excessively large droplets would make it impossible to uniformly distribute the moisture in the paper web, i.e., in the Z-direction, which, in turn, would lead to a deterioration of the quality during the treatment in the nips.

Since especially in the case of a steam application immediately in front of the first nip, as proposed in DE 43 01 023 C2, the paper web is treated gently in the calendar, it is possible to supply the paper web to the calendar with a relatively high initial moisture. Accordingly, the present invention provides that the moisture content of the paper web is increased by the spray mist application by about 5 to 7%. Consequently, starting from an average moisture of 2 to 4% after leaving the paper machine, the paper web has after moistening a moisture of about 7 to 11%. The increased moisture content makes possible a better deformability of the paper web at the first nip of the supercalender.

In accordance with a further development of the present invention, a better penetration of the moisture in the Z-direction into the paper web is achieved by producing the spray mist with water having a reduced surface tension. Thus, in accordance with the invention, the spray mist is produced with warm water or tensides or the like are added to the spray mist water in order to reduce the surface tension.

In accordance with the invention, the droplet size is reduced by spraying the spray mist with air.

The present invention further provides that the moisture of the paper web is determined before and/or behind the moistening unit and moistening is controlled in dependence on the determined actual moisture values and the predetermined nominal values.

In accordance with a further development of the invention, the gloss and/or the smoothness of the paper web are measured and any gloss and/or smoothness differences over the width of the paper web are determined. The individual spray heads of the nozzle-type moistening unit can be controlled individually, so that the application of mist can be adjusted in the transverse direction of the paper web according to the determined gloss and/or smoothness differences.

In accordance with the invention, the upper and bottom sides of the paper web are moistened, so that the quantity of moisture to be applied to each individual side can be reduced accordingly. In addition, when moisture is applied to only one side, there may be problems with respect to the flatness of the paper web, i.e., the border areas may slightly bend.

Finally, in accordance with the present invention it is further provided that the paper web is moistened with steam immediately prior to the first nip of the supercalender and is guided through the first nip before the increased moisture of the surface resulting from the application of steam has dropped below a predetermined value in the range of 12% to 25%. As a result, as already described above, the influence of the nip on the paper web is essentially limited to the surface portions of the paper web and a gentler treatment of the paper web in the supercalender is made possible. By applying steam, it is additionally possible to compensate for flatness problems of the paper web, so that the paper web enters the supercalender properly in a flat state.

In accordance with the present invention, in an apparatus for the on-line manufacture of paper including a paper machine with a dry end and a supercalender (multinip soft calendar) with a plurality of nips through which the paper web travels following the dry end, a moisture application device with at least one nozzle-type moistening unit is arranged following the dry end of the paper machine for applying a spray mist on the paper web, wherein the distance of the moisture application device from the supercalender is such that the paper web travels through the first nip about 0.6 to 1.2 s, preferably 0.8 to 1 s, after the moistening of the paper web.

In accordance with the present invention, the moisture application device has at least one nozzle unit for the upper and the bottom side of the paper web.

In accordance with a preferred development of the invention, a suction means is provided at the nozzle unit which makes it possible to hold the mist within the system and to ensure a uniform distance of the paper web from the nozzles. The suction means produces a negative pressure which serves to compensate for the fact that the paper web is pressed by the spray mist application away from the nozzle unit.

In accordance with a further development of the present invention, especially the nozzles for moistening the upper side of the paper web are arranged horizontally; this is because a downward spraying direction could result in problems concerning the formation of droplets.

In accordance with a preferred feature, a plurality of spray heads are arranged next to each other in the nozzle unit. In accordance with the invention, these nozzle heads can be controlled individually or in groups. This makes it possible to compensate for any determined gloss and/or smoothness differences in the transverse direction of the paper web by appropriately controlling the spraying intensity of individual spray nozzles.

A steam delivery device is provided immediately prior to the first nip of the supercalender, so that the temperature increase and moisture increase of the paper effected by the steam application has not yet been equalized when the paper web travels through the nip.

In accordance with a further development of the invention, a steam discharge device each is arranged on both sides of the paper web in front of the first nip of the supercalender, so that the improvement of the gloss and smoothness properties takes place simultaneously on the upper side as well as on the bottom side of the paper web.

In accordance with a further development of the invention, a measuring frame is provided prior and/or behind the moisture application device, wherein the measuring frame determines the moisture of the paper web, and wherein the determined measurement values are utilized for controlling the moisture application device and/or the steam delivery device.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
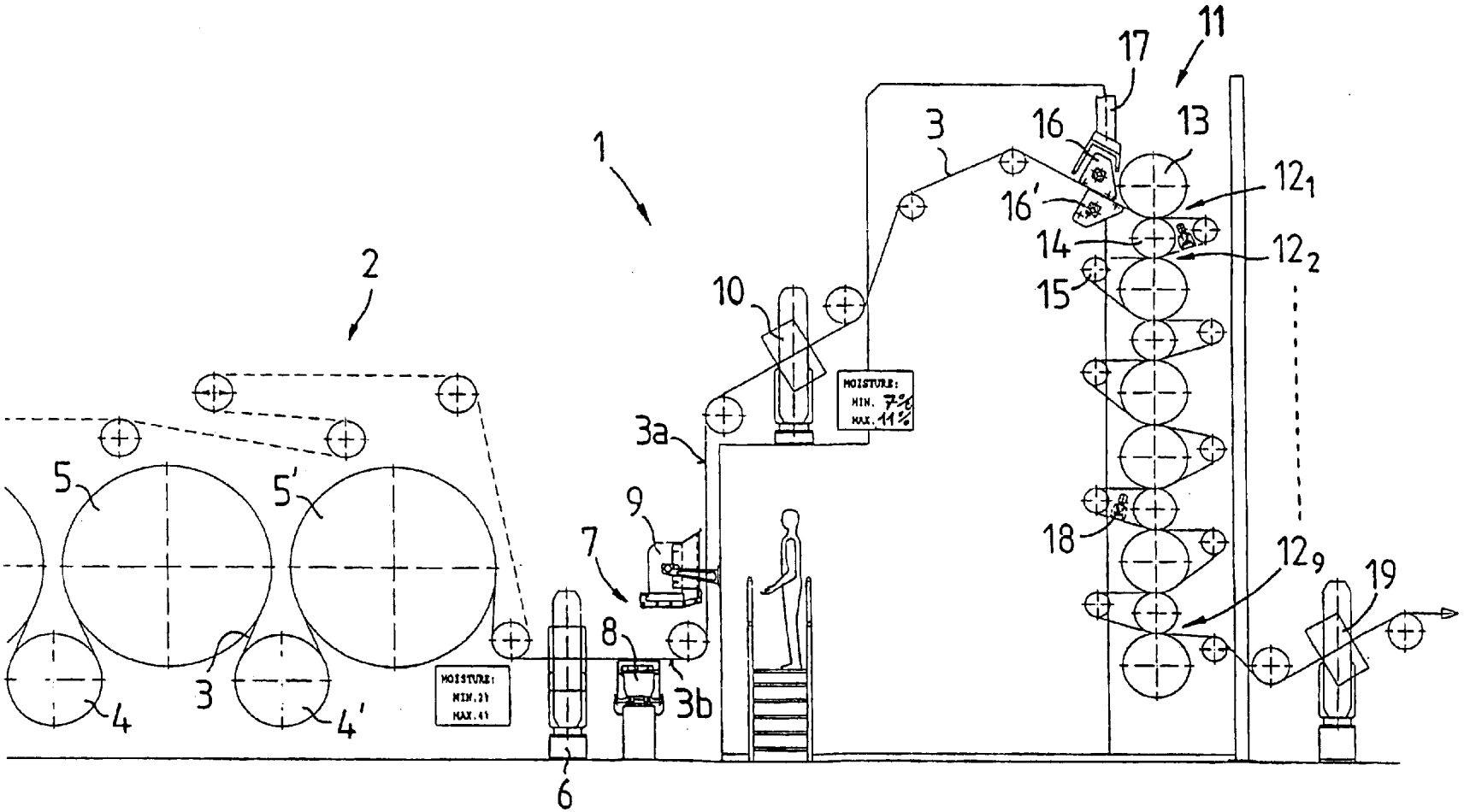
FIG. 1 is a schematic illustration of the apparatus according to the present invention for the on-line manufacture of paper.

An apparatus 1 for the on-line manufacture of paper having a high smoothness, especially SC-A paper includes a paper machine, wherein the drawing only shows the last section of the dry end 2 of the paper machine. The specific configuration of the paper machine is not material with respect to the present invention.

In the illustrated section of the dry end 2 of the paper machine a paper web 3 travels around two suction rolls 4, 4' and two drying rolls 5, 5' which cause the moisture of the paper web 3 to drop to about 2 to 4% and which provide the paper web with the necessary stability. The moisture is measured by a moisture measuring frame 6.

Following the dry end 2, the paper web 3 travels through a moisture application device 7 which has a nozzle-type moistening unit 8, 9 each for the upper and bottom side 3*a*, 3*b* of the paper web 3. The configuration of the nozzle-type moistening unit is described later. It should only be mentioned at this point that the nozzle unit 9 provided for the upper side 3*a* of the paper web 3 is arranged in such a way that spraying of the moisture onto the paper web 3 takes place essentially horizontally.

Following the moisture application device 7, the moisture content of the paper web 3 is determined again by a measuring frame 10.

Subsequently, the paper web 3 travels on-line into a supercalender 11. The supercalender 11 has a plurality of nips $\mathbf{12}_1$ to $\mathbf{12}_9$, which are successively travelled through by the paper web 3. The supercalender referred to is a multinip soft calendar. Each nip 12 is formed by a polymer roll 13 and a steel roll 14 which is heated to at least 125° C., preferably up to 150° C.

Guide rolls 15 are provided for guiding the paper web 3 through the appropriate nips 12.

A steam delivery device 16 is provided immediately in front of the first nip $\mathbf{12}_1$ of the supercalender 11. The steam delivery device 16 may particularly be composed of a steam blowing box as it is described in DE 43 01 023 C2. In the illustrated embodiment, the steam delivery devices 16, 16' are provided on the upper side 3*a* and the bottom side 3*b* of the paper web 3. A suction means 17 for removing the oversaturated air is provided at the steam delivery device 16, 16'.

Additional steam delivery devices 18 are provided in the supercalender 11 in front of additional nips $\mathbf{12}_2$, $\mathbf{12}_7$. These additional steam delivery devices 18 remoisten the paper web 3 in order to partially compensate for the moisture loss in the nips 12.

Following the supercalender 11 is provided a measuring frame 19 for determining the gloss and/or smoothness of the paper web 3.

Figure 2:
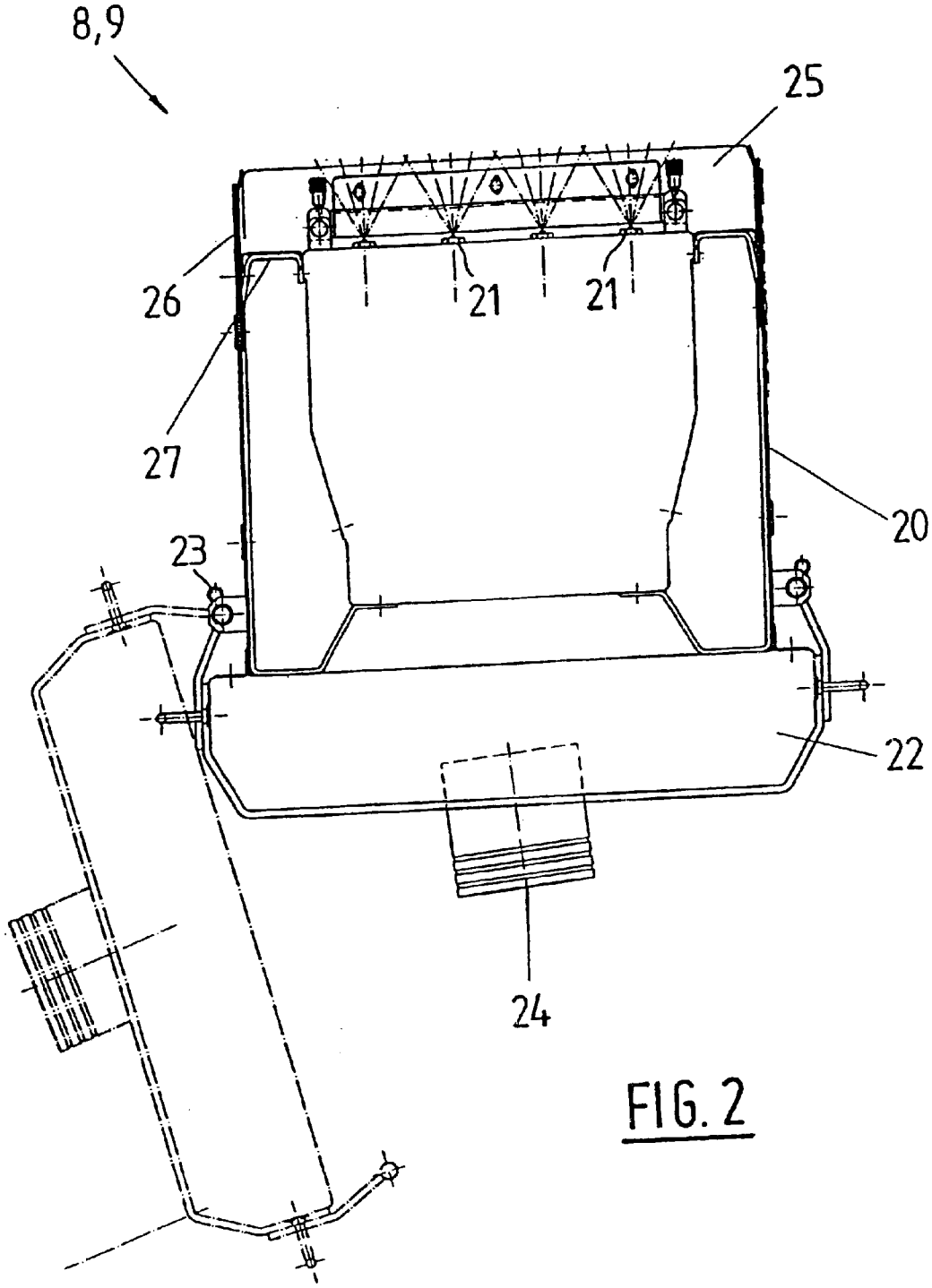
FIG. 2 is a sectional view of a nozzle-type moistening unit.

FIG. 2 shows in more detail a nozzle unit 8, 9 used for moistening the paper web in the moisture application device 7.

The nozzle unit 8, 9 has a housing 20, wherein on the side of the housing 20 facing the paper web are arranged next to each other a plurality of spray heads 21, for example, of the type known from DE 38 19 762 C2. The spray heads 21 can be controlled individually or in groups in such a way that the spraying intensity can be varied. Additionally provided on the housing 20 is a drip basin 22 in which condensated liquid can collect. For assembly and maintenance purposes the drip basin 22 can be pivoted about a hinge 23, so that the interior of the housing 20 and the spray heads 21 are accessible. Provided on the housing 20 in the area of the drip basin 22 is additionally a suction unit 24 which serves to hold the mist in the system and to maintain the paper web at a uniform distance from the spray heads 21. In order to protect the area in which water is sprayed onto the paper web and to prevent problems with respect to moistening, edge covers 25 are provided at the driving and guiding side, wherein the edge covers 25 have adjustable sealing ledges 26. Perforated sheet metal pieces 27 serve to achieve a pressure equalization in the spraying area and the return of any condensated liquid into the drip basin 22 is made possible.

Instead of the supercalender 11 illustrated in FIG. 1, it is also possible to use a so-called double-stack supercalender in which two groups of nips are arranged following each other through which the paper web travels successively. This reduces the structural height of the calendar. The apparatus 1 otherwise remains unchanged. The process according to the present invention can be carried out in a double-stack calendar in the same manner as in the calendar illustrated in the drawing.

In the following, the manner of operation of the apparatus 1 according to the present invention will be described.

The paper web 3 emerging in the usual manner from the dry end 2 of the paper machine has a moisture of about 2 to 4% by weight, wherein the moisture is measured in the measuring frame 6. Spray mist is sprayed in the moisture application device 7 by the nozzle-type moistening units 8, 9 onto the upper and bottom sides 3*a* and 3*b* of the paper web 3. Since the duration of the absorption of the moisture into the paper web 3 depends significantly on the droplet size, the average droplet size should be $<50\ \mu m$, preferably $\leqq 20\ \mu m$. Particular care must be taken that a fine uniform moisture mist is produced which can be metered by appropriate controlling of the spray heads 21. In order to facilitate the penetration of the moisture in the Z-direction into the paper web 3, the surface tension of the water used for the spray mist is reduced by heating the water and/or adding tensides or the like to the water. Following the moistening step in the moisture application device 7, the moisture of the web is once again evaluated in the measuring frame 10; at this stage, the paper web 3 has a moisture of about 7 to 11%. Consequently, the moisture application device produces a moisture increase of 5 to 7%. In order to ensure that the moisture applied in the form of droplets onto the paper web 3 can uniformly distribute over the paper web and in the Z-direction, the moisture application device 7 is arranged approximately 0.6 to 1.2 s, preferably 0.8 to 1 s, in front of the first nip $\mathbf{12}_1$ of the supercalender 11. It may even be sufficient if the moisture application device 7 is arranged only 0.4 to 0.6 s in front of the first nip $\mathbf{12}_1$. Consequently, the location where the moisture application device 7 is to be arranged depends on the paper machine speed. In the case of a paper machine speed of 1,400 m/min and a desired time interval of 0.7 s between moistening and the first nip, the distance is about 16.3 m. When the paper machine speed is changed, the moisture application unit 7 must be shifted accordingly.

Immediately prior to the first nip $\mathbf{12}_1$ of the supercalender 11, the steam delivery device 16, 16' applies hot steam which is free of droplets onto the surface of the paper web, wherein the steam temperature in the steam blowing chamber of the steam delivery device 16, 16' is approximately in the range of 102° C. to 110° C. in order to exclude a condensation of the steam. The steam delivery device 16, 16' is now moved as close as possible to the nip $\mathbf{12}_1$, wherein the distance can be adjusted in dependence on the speed with which the paper web 3 travels through the nip 12. The steam emerging from the steam delivery device 16, 16' spreads out with a relatively uniform pressure and a uniformly high speed of, for example, 25 m/s or more. As soon as the steam comes into contact with the relatively cold paper web 3, the steam condensates and causes the temperature at the surface of the paper web 3 to increase drastically. In the case of a paper web 3 having a temperature of about 30° C., the surface will have increased to a temperature of about 90° C. after the condensation of the steam. Simultaneously, the condensated steam forms a moisture film whose thickness is, for example, in the range of one thousandth of a millimeter. The condensation produces an almost explosive temperature increase of the surface of the paper web 3 which, however, evens out within a very short time over the thickness of the paper web 3, so that the paper web has within fractions of a second a uniform temperature distribution. The levelling out of the moisture takes somewhat longer because the moisture penetrates more slowly into the paper web 3 than the temperature. (However, in the case of steam application, levelling out of the moisture takes place significantly faster than in the case of moistening by a spray mist.) This is why the uppermost layer (approximately a third of the paper web in a SC-A paper having a material weight of about 50 $g/m_2$) has a significantly higher relative moisture than the middle portion of the paper web 3. The more the moisture penetrates into the interior of the paper web 3, the more the relative moisture decreases. However, before the moisture of the surface of the paper web 3 (upper third, or lower third in the case of steam application from below) has dropped below a predetermined value in the range of 12% to 25%, particularly of 16% to 25%, the paper web 3 travels through the first nip $\mathbf{12}_1$ of the supercalender 11. The temperature of the paper web 3 has at this point in time also not yet levelled out; rather, the temperature increase in the middle third of the paper web resulting from the steam application should not have yet reached 1/e times the temperature increase of the surface of the paper web 3.

The treatment of the paper web in the first nip $\mathbf{12}_1$ of the supercalender 11 causes the surface of the web 3, which still has the increased temperature and moisture, to be smoothed and to be provided with an increased gloss. The portions of the paper web 3 located further in the interior thereof are not significantly changed by the nip $\mathbf{12}_1$. The paper web 3 subsequently travels through the additional nips $\mathbf{12}_2$ through $\mathbf{12}_9$ of the supercalender 11, wherein the paper web 3 is remoistened in front of individual nips by the steam delivery device 18 in order to improve the increase of the gloss and smoothness.

The moistening by the moisture application device 7 and the steam discharge by the steam delivery devices 16, 16', are controlled on the basis of the determined measurement values of the measuring frame 6 and 10 and the predetermined nominal values. Similarly, gloss and smoothness values determined by the measuring frame 19 together with appropriately predetermined nominal values serve for controlling the steam application in the steam application device 16, 16' and, if applicable, the heating of the calendar roll 14.

The present invention supplies to the supercalender 11 a paper web 3 having a high initial moisture. Together with the gentle treatment of the paper web having a high moisture and temperature in the surface portions, this high initial moisture makes possible the on-line manufacture of paper with excellent smoothness values.

While specific embodiments of the invention have been shown and described in detail to illustrate the inventive principles, it will be understood that the invention may be embodied otherwise without departing from such principles.

We claim:

1. An apparatus for on-line manufacture of paper comprising a paper machine having a dry end and a supercalender arranged on-line following the dry end, the supercalender having a plurality of nips through which a paper web travels, further comprising a moisture application device following the dry end of the paper machine, the moisture application device comprising at least one nozzle-type moistening unit for applying a spray mist onto the paper web, wherein the moisture application device is configured to uniformly moisten the paper web in a Z-direction of the paper web by being spaced from the super calender such that the paper web travels through a first nip of the supercalender about 0.6 to 1.2 s after the application of the spray mist, further comprising a steam delivery device arranged immediately in front of the first nip of the supercalender and downstream of the moisture application device in a travel direction of the paper web, the steam delivery device being mounted such that a temperature and moisture increase of the paper web resulting from the steam application is not leveled out when the paper web travels through the first nip.

2. The apparatus according to claim 1, wherein the moisture application device is spaced from the supercalender such that the paper web travels through the first nip of the supercalender 0.8 to 1 s after the moisture application.

3. The apparatus according to claim 1, wherein the moisture application device comprises at least one nozzle-type moistening unit each on an upper side of the paper web and a bottom side of the paper web.

4. The apparatus according to claim 1, further comprising a suction means mounted on the nozzle-type moistening unit.

5. The apparatus according claim 1, wherein the at least one nozzle-type moistening unit comprises a plurality of spray heads arranged next to one another.

6. The apparatus according to claim 5, comprising means for controlling the spray heads individually or in groups.

7. The apparatus according to claim 5, wherein the moisture application device comprises a nozzle-type moistening unit for moistening an upper side of the paper web, the nozzle-type moistening unit having horizontally arranged spray heads.

8. The apparatus according to claim 1, comprising a steam delivery device each on both sides of the paper web arranged in front of the first nip of the supercalender.

9. The apparatus according to claim 1, further comprising a measuring frame arranged at least one of in front of and following the moisture application device for determining a moisture content of the paper web, and means for controlling the moisture application device based on measurement values determined by the measurement frame.

10. The apparatus according to claim 1, comprising a moisture application device each on both sides of the paper web arranged in front of the first nip of the supercalender.

* * * * *